US007254926B2

(12) United States Patent
Eldeen

(10) Patent No.: US 7,254,926 B2
(45) Date of Patent: Aug. 14, 2007

(54) DECK BRACKET AND METHOD OF ATTACHING A DECK TO A BUILDING

(76) Inventor: Barry Eldeen, 15650 Galaxie Ave., Apple Valley, MN (US) 55124

( * ) Notice: Subject to any disclaimer, the term of this patent is extended or adjusted under 35 U.S.C. 154(b) by 563 days.

(21) Appl. No.: 10/765,354

(22) Filed: Jan. 27, 2004

(65) Prior Publication Data

US 2005/0160683 A1 Jul. 28, 2005

(51) Int. Cl.

| | |
|---|---|
| ***E04B 1/38*** | (2006.01) |
| ***E04B 1/00*** | (2006.01) |
| ***E04C 5/00*** | (2006.01) |
| ***E04H 12/00*** | (2006.01) |
| ***E04G 21/00*** | (2006.01) |
| ***E04G 23/00*** | (2006.01) |

(52) U.S. Cl. ..... 52/698; 52/650.3; 52/713; 52/745.21

(58) Field of Classification Search ..... 52/698, 52/712, 713, 714, 702, 293.3, 289, 745.06, 52/745.21, 262, 263, 272, 282.3, 282.1, 282.4, 52/282.5, 284–285.4, 283, 236.6, 236.7, 52/236.9, 739.1, 643, 650.3; 248/235, 247, 248/250, 297.21

See application file for complete search history.

(56) References Cited

U.S. PATENT DOCUMENTS 4,229,919 A * 10/1980 Hughes ..... 52/263
4,811,542 A * 3/1989 Jewell ..... 52/745.21
5,201,156 A * 4/1993 Newman ..... 52/299
6,311,449 B1 * 11/2001 Morse et al. ..... 52/702
6,397,552 B1 * 6/2002 Bourque ..... 52/712
6,427,391 B1 * 8/2002 Lyons ..... 52/73

* cited by examiner

*Primary Examiner*—Carl D. Friedman
*Assistant Examiner*—Hunter M Dreidame
(74) *Attorney, Agent, or Firm*—Gary L. Huusko

(57) ABSTRACT

An apparatus and method are disclosed for attaching a deck to a building. The apparatus and method disclose a deck bracket with an L shaped bracket, a solid bar, preferably threaded at both ends, and a sheath which would surround a support member of the building. The solid bar could be of various lengths, depending upon the structure to which it will be attached. The L shaped bracket has a support piece fixedly attached to the back side of its long, vertical side, and has a threaded bore through the support piece and L shaped bracket, with which to accept one of the threaded ends of the solid bar. The short, horizontal side of the L shaped bracket would hold one or more of the deck rim joists or deck supporting beams. The solid bar would thus extend into holes drilled into a various support members of the house or like structure, around one of those support members would be the sheath, thus allowing a portion of the load of the deck to be transferred to the building structure, and also allowing for a space to exist between the deck and the building so as to prevent the accumulation of moisture and thereby preventing the decay of either the building or deck structures at the point of attachment.

20 Claims, 6 Drawing Sheets

DECK BRACKET AND METHOD OF ATTACHING A DECK TO A BUILDING

FIELD OF THE INVENTION

This invention relates to a deck bracket and method of attaching a deck to a building. More particularly, the invention concerns a mounting bracket and attachment method, which attaches a deck to structural supports of a building.

BACKGROUND OF THE INVENTION

The most significant concerns in attaching a deck to a building are the use of improper or inadequate fasteners and that there is a risk that moisture may be trapped and accumulate at the point of attachment, thus creating conditions for decay and weakening of the materials at the point of attachment.

Improperly fastening the deck to the building can cause the deck to become unattached, thereby creating a danger for those persons on or around the deck. Some deck and balcony ledgers are only nailed to the house band joist, and this approach may not be adequate depending upon the span of the deck joists. As people gather on a deck, their weight and movement translate not just into a downward force but also into an outward force that acts as a lever prying the deck away from the house. Nails work well to resist the downward force but are inadequate for the outward force. Held in place only by the friction of bent wood fibers, nails tend to loosen when wood alternately shrinks and swells with changes in moisture content and temperature. Once nails loosen, they offer even less resistance to the prying forces of a crowd of people standing on the deck floor.

A screwed-in connector behaves differently. It gains increased frictional strength from the wedging action of wood fibers along the entire length of the shaft. A lag bolt, which looks like a giant screw, has as much as nine times the pullout resistance of a nail for every inch of penetration. Better still is the metal-to-metal connection of a true bolt, inserted in a drilled hole and fitted with a nut on the other side. Placing a washer on both sides spreads the pulling force over a larger portion of the beam. Both of these connectors offer an extra benefit over nails in that they don't suddenly pull out as wood shrinks and swells. But they may loosen over time, requiring periodic inspection and maintenance.

Also, if proper flashing is not installed, the wall sheathing and band joist can rot, destroying the original capacity of the nail connection. This could set up a situation where wood members of both the structure and deck are susceptible to rot. Accordingly, a number of prior art systems and methods have been developed to minimize the probability of trapping moisture at the point of attachment of a deck to a structure.

A common method of attaching a deck to a building is by installing roll flashing to the exterior of the structure. In new construction, the roll flashing is likely attached prior to the siding being attached. However, where a deck is to be attached to an existing structure, with attached siding, the siding should first be removed to expose the sheathing. After the roll flashing is attached, then a rim joist is attached over the roll flashing to the structure, preferably using lag bolts. The lag bolts will penetrate through the rim joist, flashing and sheathing and into a rim joist of the structure. Next, a window flashing is attached to the top of the attached rim joist to direct any moisture over the rim joist and away from the structure. Siding is then attached on top of the window flashing to complete the installation.

Although this is a common form of deck installation that has been used for many years, it is not without problems. Water can drip along or condense on the lag bolts, following the lag bolts to the inside of the house. This is especially problematic in climates that experience severe temperature swings between the summer and winter months. During the winter months, water can find its way behind the siding and alternatively thaw and freeze in response to temperature fluctuations, thus weakening the joint between the deck and the building.

In a typical home construction scenario, the house is built and sided before a deck or other accessory devices are attached to the house. Thus, in order to properly attach a deck to the house using methods described in prior art, the siding contractor will either need to leave part of the house without siding to allow the deck to be fastened thereto or already attached siding must be removed in order to properly attach the deck to the house. Both installation types add complexity and coordination problems to a construction project.

A number of prior patents disclose alternative methods of attaching a deck to a house. In U.S. Pat. No. 6,397,552 to Bourque, a deck attachment bracket and method of attaching a deck to a building is disclosed by use of an attachment bracket being mounted to the concrete foundation of an existing structure, preferably having a space between the structure and the deck. While Bourque's bracket and method may solve the problem of deteriorating and rotting wood joists, water may still find its way along the bolts into the concrete, allowing for its expansion and contraction in freezing and thawing weather, thereby weakening the hold of the bolts to the concrete. Thus, additional modification must be performed, such as caulking or otherwise sealing around the bolt holes, to prevent water from infiltrating the bolt holes.

In U.S. Pat. No. 6,311,449 to Morse, et al. discloses an "L" shaped bracket, the longer leg through which bolts are used to attach the bracket to the band board and joist of the house, the shorter leg through which bolts are used to attach to the band board of the house and ledger boards of the deck. As can be appreciated, this bracket and method does not solve the problem of water deteriorating the wood, thereby weakening the place of attachment.

Another example, U.S. Pat. No. 4,811,542 to Jewell discloses a deck bracket, which includes a wide flange and a narrow flange spaced apart from each other by a web. The deck bracket is then joined to the building, preferably by screws and the deck bolted to the deck bracket. The deck is thus spaced away from the building to reduce moisture accumulation. Jewell's method of construction however, includes placing the deck bracket adjacent to sheathing, caulking it and then protecting the area with siding, thus covering it. While the Jewell bracket does separate the deck structure from a building structure and thus reduces the possibility that moisture will be trapped between the two structures, it still requires siding modifications and caulking to prevent moisture draining down the siding of the structure thus accumulating and penetrating through the screw holes attaching the bracket to the structure.

Further, U.S. Pat. No. 5,201,156 to Newman also discloses a mounting bracket, which spaces a deck or the like away from the siding of a house or other like structure in order to prevent the accumulation of water at the joint. However, like the Bourque and Jewell brackets, Newman's bracket requires modifications to the exterior of a structure and/or caulking or the like in order to effectively waterproof the joint between the bracket and the house structure.

What is needed, therefore, is a deck attachment bracket and method that eliminates the joint between a deck and/or deck bracket and the exterior of a house or other structure, thereby eliminating any possibility that moisture could penetrate into the wooden house or other structure. What is further needed is an attaching means that will diminish or eliminate the reliance of the structural integrity solely upon the wooden members of the deck or attached structure. Preferably, such a bracket and attachment method should be adjustable to allow a single bracket design to be compatible with a variety of deck configurations and orientations.

SUMMARY OF THE INVENTION

According to the present invention, a deck attachment bracket and method of attaching a deck to a building are provided. The attachment bracket comprises an L shaped bracket, a solid bar, preferably threaded at both ends, and a sheath. The solid bar could be of various lengths, depending upon the structure to which it will be attached. The L shaped bracket has a mounting support member piece fixedly attached to the back side of its long, vertical side, and has a bore through the support piece and L shaped bracket, with which to accept one of the ends of the solid bar. In the preferred embodiment, the bore would be threaded so as to accept a threaded end of the solid bar. The solid bar may also be attached to the L shaped bracket and mounting support member by welding or some other such fixed means. The short, horizontal side of the L shaped bracket would hold one or more of the deck rim joists or deck supporting beams.

The sheath is made of metal or some other strong material and fits around a support member of the house and is attached to the support member of the house by means of nails, screws or some other such means. Holes are situated in the sheath through which the nails, screws or other such means are thus inserted into the support member of the house. The sheath further has threaded holes opposite each other, thus allowing the solid bar to be threaded onto and through the sheath. The support member of the house within the sheath has a corresponding hole allowing the solid bar to pass through the support member of the house and to be threaded thereby in each threaded hole of the sheath. Another embodiment would have the solid bar extending through and past the sheath, thus allowing a nut to be screwed onto the protruding portion of the threaded solid bar.

Holes are situated within the vertical side of the L which would allow bolts to attach the bracket to the deck rim joist or support members. Holes are drilled into the deck joists or support members allowing bolts to go through those joists or support members, thus securely attaching said joists or support members to the deck bracket.

A composite or similar structural header piece is attached to the interior of the outer wall of the house or building, preferably on top of the foundation, through each of which a hole has been drilled, thus allowing the solid bar to go through that composite member and the outer wall of the house. The composite header can be made of laminated wood or other strong, sturdy material. A second support member, also with a hole drilled at the proper place and made of wood or similar material, is attached within the house floor joists such that the sheath would be placed around the second support member, thus allowing the end of the solid bar to extend through the hole. The holes described in the outer wall of the house or other structure, the composite header attached to the inner wall of the outer wall of the house or other structure, the floor joists or other like structural support members, and the second support member within the floor joists are situated such that the holes are aligned so that the solid bar end of the deck bracket is horizontally level. Another embodiment shows a sleeve with securing screw situated around the solid bar such that the sleeve is slid along the bar and is situated so as to abut the side of the composite support member that is facing away from the L shaped bracket, and the securing screw is tightened to hold the sleeve tightly to the solid bar and against the composite member, thus restricting the movement of the deck bracket.

The deck bracket thus allows the weight of the deck to be distributed along the solid bar, thus relieving and reducing the stress upon any one point at which the deck is attached to the house or building.

The deck attachment method includes using a plurality of deck attachment brackets to attach the deck to the house. Once the deck rim joist is attached to the bracket, then the remaining steps of deck construction proceed according to prior art practices.

DESCRIPTION OF THE DRAWINGS

These and other claims of the present invention will be more fully understood by reading the following detailed description taken together with the drawings wherein:

DETAILED DESCRIPTION OF THE DRAWINGS

Figure 1:
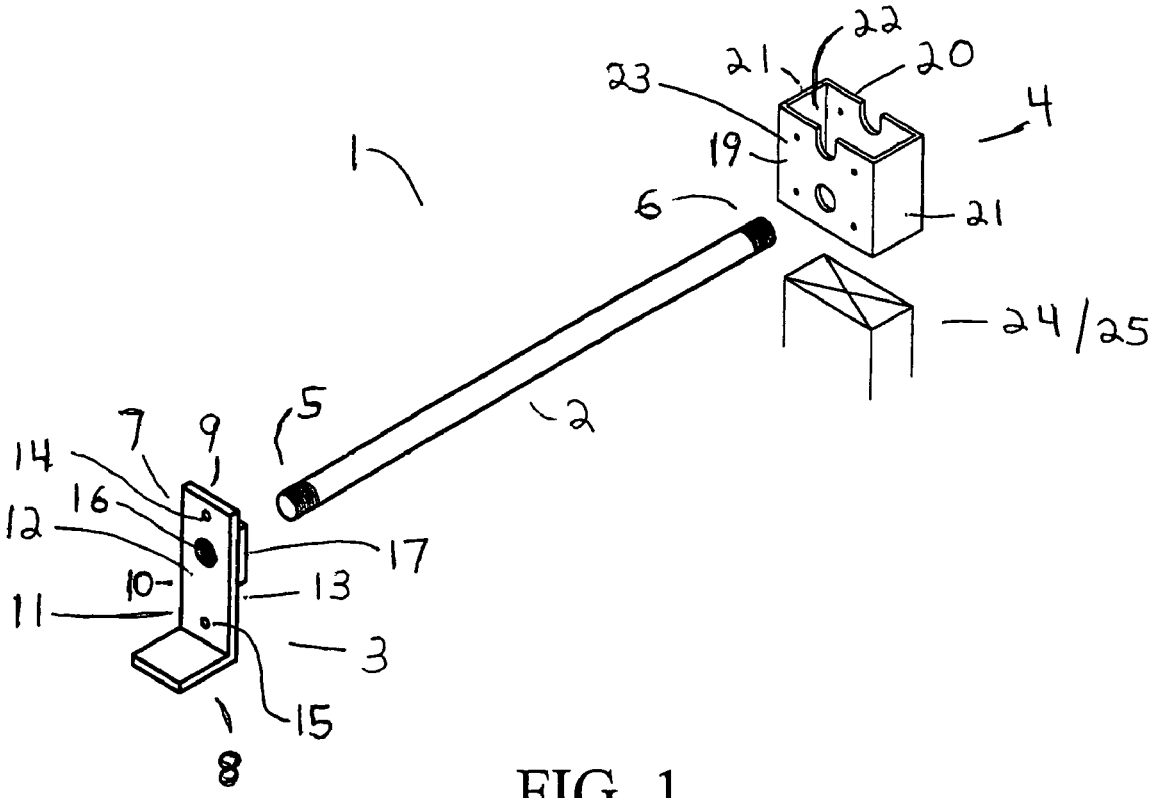
FIG. 1 is a perspective exploded view of a deck bracket showing the L shaped bracket, threaded solid bar and sheath.

Referring first to FIG. 1, the preferred embodiment of a deck bracket 1 is shown, having a solid bar 2, an L shaped bracket 3 and a sheath 4. The deck bracket 1 is made out of steel or some other such high strength material. The solid bar 2 has a first end 5 and a second end 6. The solid bar 2 can be of various lengths, depending upon the height of the deck to be attached and where the deck rim joists will attach to the house or other structure. The preferred embodiment has the solid bar 2 being two feet six inches in length, although a longer or shorter length will work.

Figure 2:
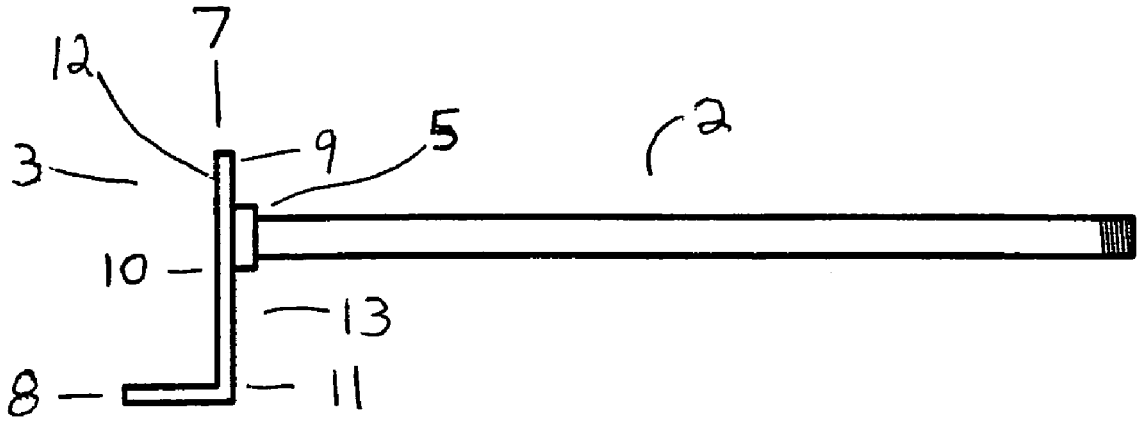
FIG. 2 is side view of the deck attachment bracket.

Referring now to FIG. 2, the L shaped bracket 3 has a vertical side 7 and a horizontal side 8. The vertical side 7 has an upper end 9, a middle portion 10, a lower end 11, a front face 12 and a back 13. The first end 5 of the solid bar 2 is attached to the vertical side 7 of the L shaped bracket 3. The vertical side 7 of the L shaped bracket 3 has a plurality of bolt holes.

Figure 1A:
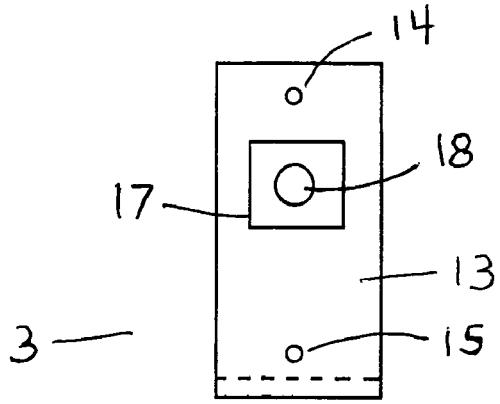
FIG. 1*a* is a back view of the L shaped bracket.

Referring to FIGS. 1 and 1*a*, the preferred embodiment shows two bolt holes, an upper bolt hole 14 situated in the upper end 9 of the vertical side 7 of the L shaped bracket 3, and a lower bolt hole 15 situated in the lower end 11 of the vertical side 7 of the L shaped bracket 3. A first bore 16 is situated above the middle portion 10 of the vertical side 7 of the L shaped bracket 3. The first bore 16 has a diameter of sufficient measure to snugly accept the solid bar 2. A mounting support member 17 is rigidly attached to the back 13 of the vertical side 7. A second bore 18 through the mounting support member 17 is aligned with the first bore 16. The L shaped bracket 3 and the solid bar 2 are rigidly attached together. The preferred embodiment shows the first bore 16 being threaded and the first end 5 of the solid bar 2 being similarly threaded, allowing said first end 5 of the solid bar 2 to be screwed into the first bore 16. The preferred embodiment also shows the second bore 18 being likewise threaded, thereby also allowing the first end 5 of the solid bar 2 to be screwed into said second bore 18. Thus, the first end 5 of the solid bar 2 would be flush with the front face 12 of the vertical side 7 of the L shaped bracket 3.

Other attaching means can be used, such as inserting the first end 5 of the solid bar 2 into the first bore 16 and the second bore 18 such that the first end 5 of the solid bar 2 is flush with the front face 12 of the vertical side 7 of the L shaped bracket 3 and welding said first end 5 of the solid bar 2 to the L shaped bracket 3 and mounting support member 17.

Other such means can also be used to attach the solid bar 2 to the L shaped bracket 3, such as a high strength adhesive or other high strength adhesive means. Thus, the first end 5 of the solid bar 2 is flush with the front face 12 of the vertical side 7 of the L shaped bracket 3.

Referring now to FIG. 1*a*, the mounting support member 17 is shown on the back 13 of the L shaped bracket 3, and the alignment of the first bore 16 through the vertical side 7 of the L shaped bracket 3 with the second bore 18 through the mounting support member 17.

Referring again to FIG. 1, the sheath 4 is a rectangular box shaped piece, having a first wide side 19, a second wide side 20, two narrow sides 21, an inside 22 and an outer side 23, so as to fit snugly around a floor joist support member 24 or a composite support member 25 of the house or other such structure.

Figure 7A:
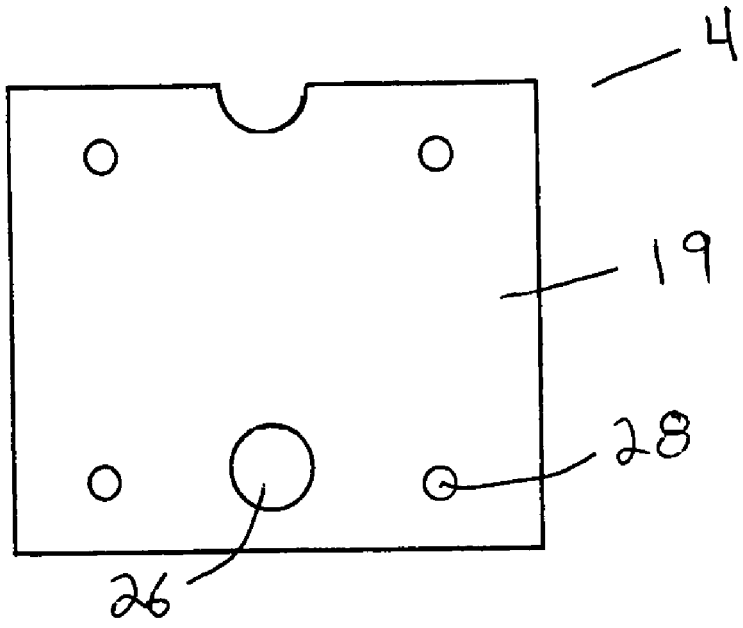
FIG. 7*a* is a front view of the sheath.
Figure 7B:
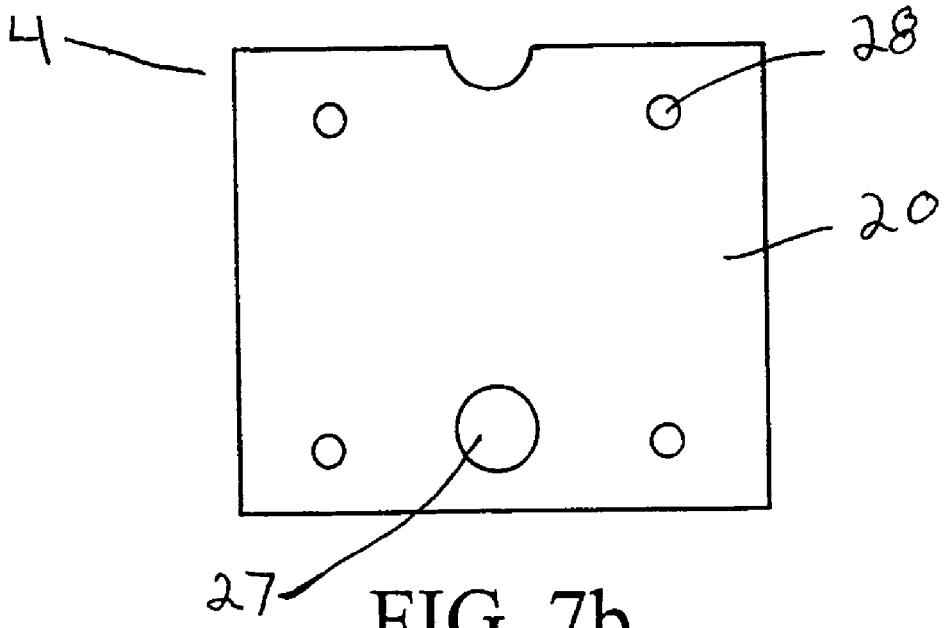
FIG. 7*b* is a back view of the sheath.

Referring now to FIGS. 7*a* and 7*b*, a first end bore 26 is situated in the first wide side 19 and a second end bore 27 is situated in the second wide side 20 such that the first end bore 26 and the second end bore 27 are of the same diameter, are of sufficient diameter to snugly accept the insertion of the second end 6 of the solid bar 2, and are aligned, thereby facilitating an aligned insertion of the second end 6 of the solid bar 2. A hole is drilled through the floor joist member 24 or the composite support member 25, as the case may be, of sufficient diameter to allow the second end 6 of the solid bar 2 to pass through said floor joist member 24 or composite support member 25. The preferred embodiment would show the second end bore 27 to be threaded, and the second end 6 of the solid bar 2 threaded as well, so that the second end 6 of the solid bar 2 would thus pass through the hole in the floor joist member 24 or composite support member 25, and would be threaded into the second end bore 27. The threads of the second end 6 of the solid bar 2 would match the threads of the second end bore 27, so as to result in a smooth placement and tight attachment.

Figure 3:
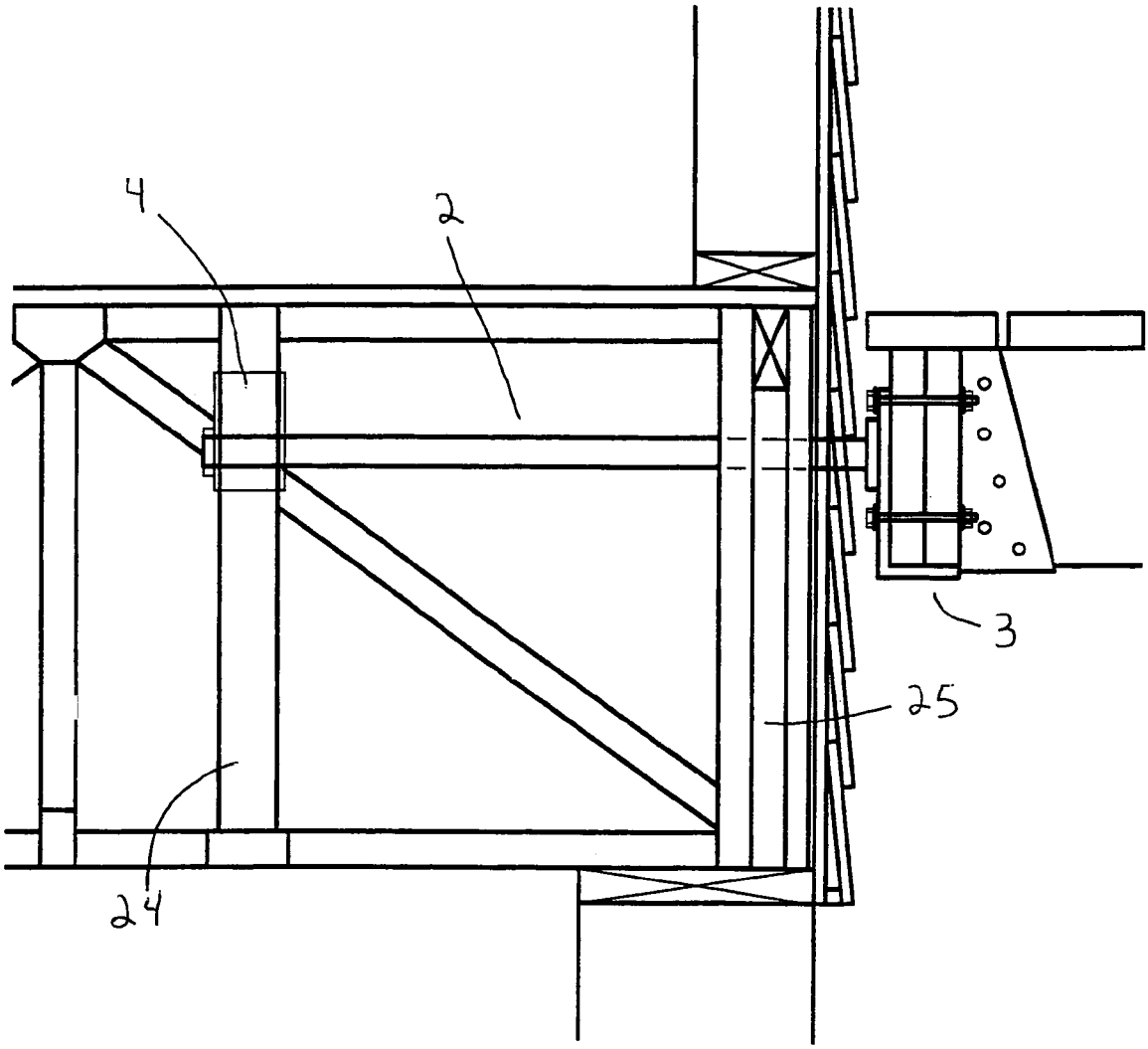
FIG. 3 is a side view of a first embodiment of the deck attachment bracket, showing the bracket attached to a house or other structure.

Referring now to FIG. 3, the preferred embodiment shows the deck bracket 1 in use in its preferred embodiment. The solid bar 2 is shown extending through the composite support member 25 and a floor joist support member 24. The floor joist support member 24 is situated between a floor joist of the house or other structure, and is fixedly attached by means of nails, bolts or similar means, to the floor joists or other like structural components of the structure.

Referring to FIGS. 7*a* and 7*b* shows the front and back views of the sheath 4. FIG. 7*a* shows the first end bore 26, and FIG. 7*b* shows the second end bore 27. A plurality of sheath bolt holes 28 are situated within the first wide side 19 and the second wide side 20, to facilitate a firm attachment of the sheath 4 to the floor joist member 24 or composite support member 25. Each sheath bolt hole 28 on the first wide side 19 of the sheath 4 aligns with an identical sheath bolt hole 28 situated on the second wide side 20 of the sheath 4. The preferred embodiment shows holes drilled through the floor joist member 24 or composite support member 25, thus allowing bolts to be used to fixedly attach the sheath 4 to the floor joist member 24 or composite support member 25, although other attaching means could also be used, such as nails, screws or even glue.

Figure 4:
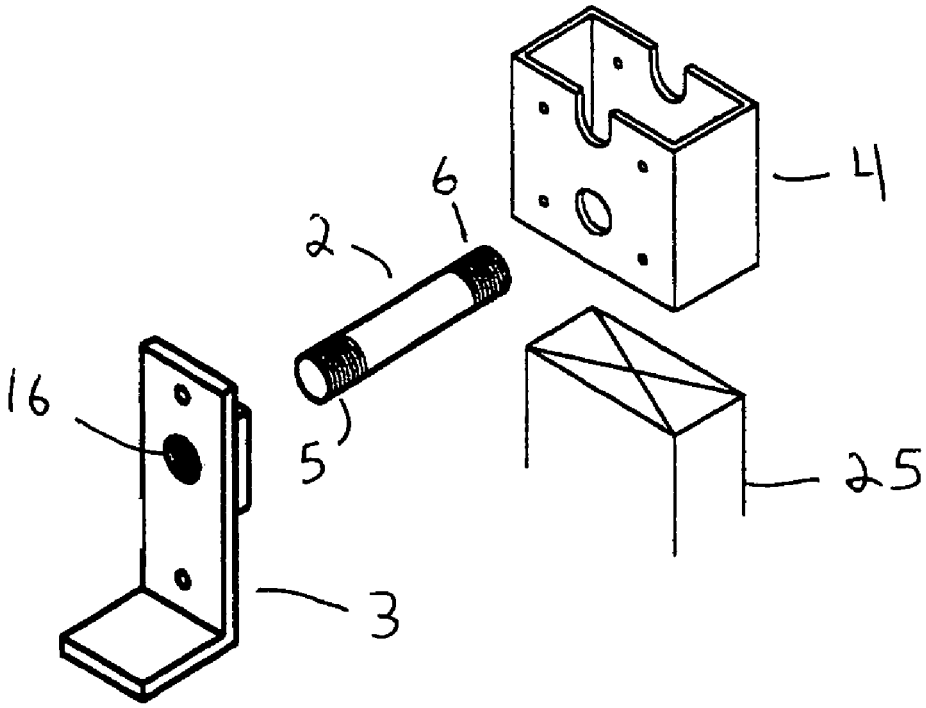
FIG. 4 is a perspective exploded view of another embodiment of the deck bracket showing the L shaped bracket, a short threaded solid bar and sheath.
Figure 5:
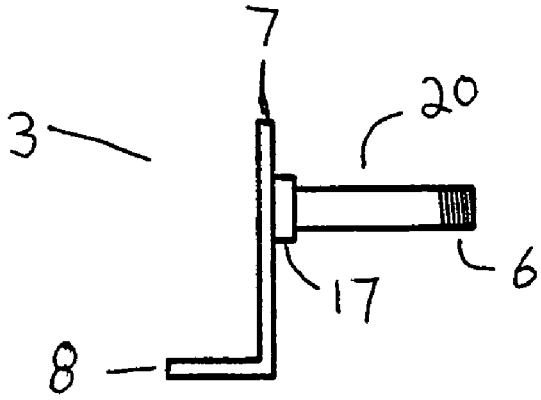
FIG. 5 is a side view of the embodiment shown in FIG. 4.
Figure 6:
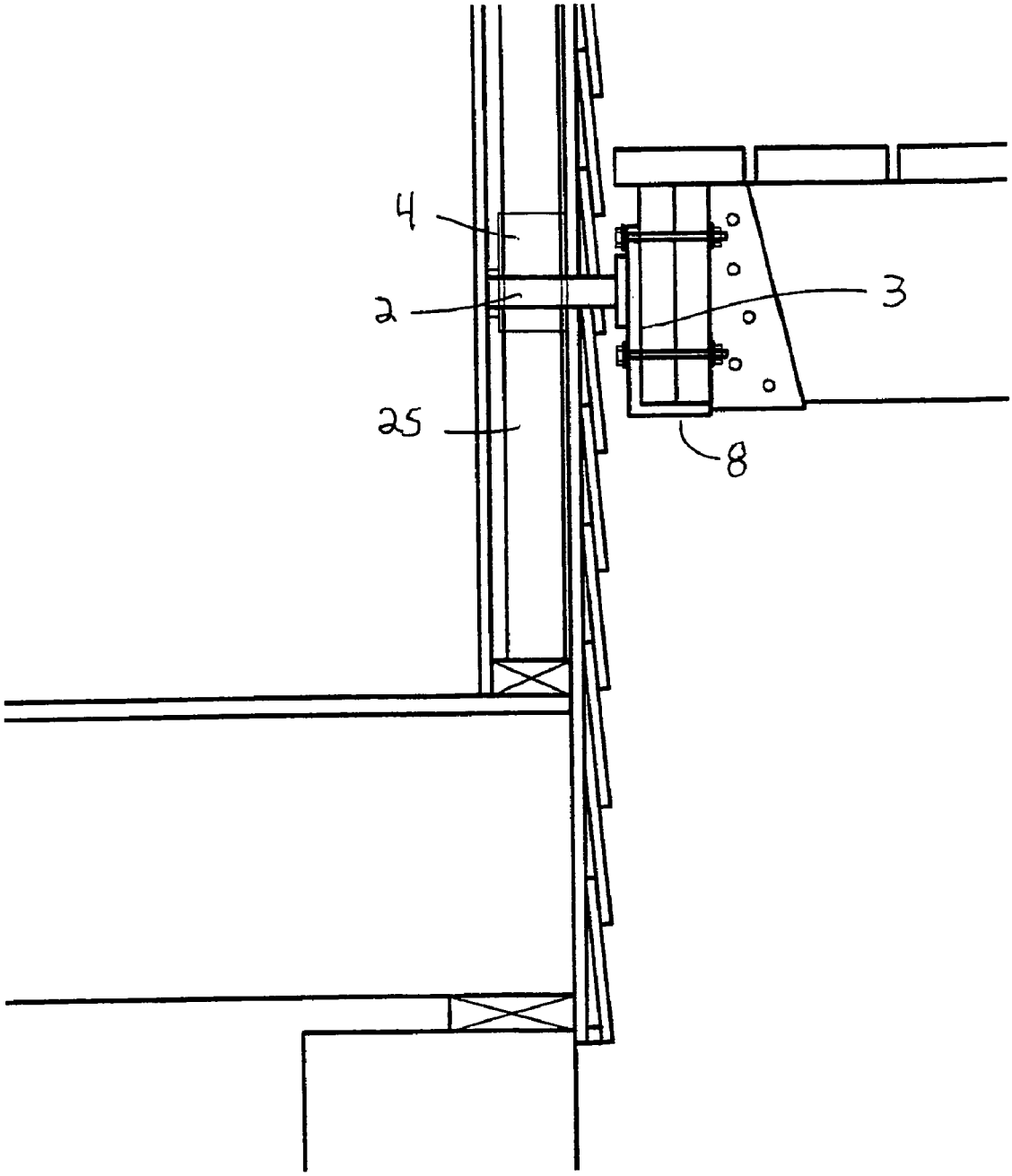
FIG. 6 is a side view of a the embodiment shown in FIG. 4 of the deck attachment bracket, showing the bracket attached to a house or other structure.

A second embodiment is shown in FIGS. 4, 5 and 6, showing the solid bar 2 of shorter length than the first embodiment. In all other respects, the deck bracket 1 is the same. This second embodiment shows the solid bar 2 being seven inches in length. In situations where structure will not allow easy access to the structural support members, such as floor joists, a short solid bar 2 is preferred.

Referring first to FIG. 4, this embodiment shows the deck bracket 1 with the shorter solid bar 2. The shorter solid bar 2 is useful when the deck is to be attached to a house or other like structure where the floor joists are not exposed and it would be inconvenient, difficult or expensive to expose the floor joists to attach the floor joist support member 24 or composite support member 25.

Referring now to FIG. 6, the second embodiment is shown in use.

While the deck bracket 1 can be made of a variety of materials, the preferred embodiment would have the solid bar 2, the L shaped bracket 3 and the mounting support member 17 being made of steel or such other strong metal or material of similar strength and characteristics. Likewise, the sheath 4 would also preferably be made of steel, tin, aluminum or such other metal or man made material such as plastic, fiberglass, a composite material or the like, of similar strength and characteristics.

Further, while the deck bracket 1 can be of varied dimensions, the preferred embodiments would have the following dimensions. The preferred embodiment of the solid bar 2 would show a cylindrical bar of one and one-quarter inches, in diameter. The first embodiment would show the solid bar having a length of two feet six inches to three feet. The second embodiment of the solid bar 2 would show a length of seven inches. The preferred embodiment of the L shaped bracket 3 would show the L shaped bracket 3 being made of one-half inch thick steel plate with a width of three inches, the front face 12 of the vertical side 7 being seven and one-half inches in length, the back 13 of the vertical side 7 being eight inches in length, and the horizontal side 8 of the L shaped bracket 3 being three and one-half inches in length; and the upper bolt hole 14 and the lower bolt hole 15 would each have a diameter of seven-sixteenths of an inch. The upper bolt hole 14 would be centered at a point three-quarters of an inch down from the upper end 9 of the vertical side 7 and one and one-half inches from either edge of the vertical side 7 of the L shaped bracket 3. The lower bolt hole 15 would centered at a point five and five-eighths inches below the upper bolt hole 14 and one and one-half inches from either edge of the vertical side 7 of the L shaped bracket 3. The first bore 16 would show a diameter of one and one-quarter inches, centered at a point two and three-quarter inches below the upper end 9 of the vertical side 7 and one and one-half inches from either edge of the vertical side 7 of the L shaped bracket 3. The preferred embodiment of the mounting support member 17 would show dimensions of two and one-half inches wide by two inches tall by three-quarters of an inch thick, and said mounting support member 17 would be attached to the back 13 of the vertical side 7 at a point one and three-quarters inches down from the upper end 9 of the vertical side 7, one-quarter inch from each side of the vertical side 7 and four and one-quarter inches from the lower end 11 of the vertical side 7. The second bore 18 through the mounting support member 17 would show a diameter of one and one-quarter inches and would be centered at a point one inch from the top and bottom of the mounting support member 17 and one and one-quarter inches from the sides of the mounting support member 17. The preferred embodiment of the sheath 4 would show dimensions of five and one-half inches wide by two and one-half inches deep by five and one-half inches tall. The first end bore 26 and second end bore 27 would each have a diameter of one and one-quarter inches and would be centered two and three-quarters inches from either side of the sheath 4 at any point along that midline of the first wide side 19 and second wide side 20, as the case may be, so long as the first end bore 26 and second end bore 27 were located at least one-half inch from the bottom of the sheath 4. The sheath bolt holes could be of varied diameters, depending upon the diameter size of the bolts, nails, screws or other attaching means used, and could be located at a variety of positions on the sheath 4, preferably near each of the four corners of each of the first wide side 19 and second wide side 20.

The deck bracket and method of attaching a deck to a building would entail said deck bracket extending from an interior of a house or other like structure through a hole in the wall of said structure, such that the L shaped bracket is situated outside of and a distance from said house or like structure, said horizontal side of said L shaped bracket holding deck rim joists or such other like deck support members, said deck members resting on said horizontal side and being fixedly attached to the front face of said vertical side of said L shaped bracket, said solid bar extending from the first bore and second bore and extending beyond said back of said vertical side of the L shaped bracket into the house or like structure, said solid bar further being situated within and through drilled holes in said composite support member or said floor joist member or both, thereby transferring load from the deck to said members, said solid bar being further supported by said sheath disposed about said floor joist member or composite support member or both, whereby a portion of the load of the deck would thereby be transferred to said structure and the deck bracket would not be in direct contact with said house or like structure other than the solid bar, which would thus diminish or prevent the accumulation of moisture, thus preventing decay of the structural or load bearing components of either the deck or house or like structure.

I claim:

1. A deck bracket for attaching a deck to a building comprising:

a solid bar, an L shaped bracket, a sheath; and a mounting support member;

said solid bar having a first end and a second end;

said L shaped bracket having a vertical side and a horizontal side;

said vertical side comprising an upper end, a middle portion, a lower end, a front face, a back side and a plurality of bolt holes;

said vertical side further comprising a first bore located between the upper end and the middle portion of the vertical side;

said mounting support member being fixedly attached to the back side of the vertical side;

said mounting support member comprising a second bore;

said first bore and said second bore being aligned in their relation to each other;

said first end of said solid bar being flush with said front face of said vertical side and being situated within said first bore and said second bore and attached to said vertical side and said mounting support member;

said sheath comprising a first wide side, a second wide side, two narrow sides, an inside, an outer side, a first end bore, a second end bore and sheath bolt holes;

said first end bore being situated within said first wide side;

said second end bore being situated within said second wide side;

said first end bore and said second end bore being aligned in their relation to each other.

2. The apparatus of claim 1 wherein the first end and the second end of said solid bar are threaded, the first bore is threaded, the second bore is threaded, and the second end bore is threaded, whereby said second end of said solid bar is screwed into the second end bore and said L shaped bracket is screwed onto said first end of said solid bar thereby fonning the deck bracket.

3. The apparatus of claim 1 wherein the plurality of bolt holes within said vertical face comprise an upper bolt hole and a lower bolt hole.

4. The apparatus of claim 1 wherein the solid bar, the L shaped bracket and the mounting support member are made of steel or such other strong metal or material of similar strength and characteristics and the sheath is made of steel, tin, aluminum or such other metal or man made material such as plastic, fiberglass, a composite material or the like, of similar strength and characteristics.

5. The apparatus of claim 1 wherein the solid bar is a cylindrical bar of one and one-quarter inches in diameter and has a length of seven inches, the L shaped bracket is made of one-half inch thick steel plate with a width of three inches, the front face of the vertical side is seven and one-half inches in length, the back of the vertical face is eight inches in length, the horizontal side of the L shaped bracket is three and one-half inches in length, the upper bolt hole and the lower bolt hole each have a diameter of seven-sixteenths of an inch, the upper bolt hole is centered at a point three-quarters of an inch down from the upper end of the vertical side and one and one-half inches from either edge of the vertical side of the L shaped bracket, the lower bolt hole is centered at a point five and five-eighths inches below the upper bolt hole and one and one-half inches from either edge of the vertical side of the L shaped bracket, the first bore has a diameter of one and one-quarter inches, centered at a point two and three-quarter inches below the upper end of the vertical side and one and one-half inches from either edge of the vertical side of the L shaped bracket, the mounting support member is two and one-half inches wide by two inches tall by three-quarters of an inch thick, said mounting support member being attached to the back of the vertical side at a point one and three-quarters inches down from the upper end of the vertical side and one-quarter inch from each side of the vertical side and four and one-quarter inches from the lower end of the vertical side, the second bore has a diameter of one and one-quarter inches and is centered at a point one inch from the top and bottom of the mounting support member and one and one-quarter inches from the sides of the mounting support member, the sheath is five and one-half inches wide by two and one-half inches deep by five and one-half inches tall, the first end bore and second end bore each have a diameter of one and one-quarter inches and are centered two and three-quarters inches from either side of the sheath at any point along that midline of the first wide side and second wide side, as the case may be, so long as the first end bore and second end bore are located at least one-half inch from the bottom of the sheath, and the sheath bolt holes are situated near each of the four corners of each of the first wide side and second wide side.

6. The apparatus of claim 1 further comprising a floor joist member, whereby said sheath is positioned about and fixedly attached to said floor joist member;

said solid bar being inserted into and through said first hole in said building, said second end of said solid bar extending to and through said second hole within said composite support member and further continuing into and through said first end bore of said sheath and continuing through a third hole in said floor joist member and further continuing to and through said second end bore, said first, second and third holes being aligned on a horizontal plane with said first bore, second bore, first end bore and second end bore;

whereby said deck bracket extends from an interior of said building such that the L shaped bracket is situated outside of and a distance from said building, said horizontal side of said L shaped bracket holding deck rim joist support members, said deck rim joist support members being fixedly attached to the front face of said vertical side of said L shaped bracket, said solid bar extending from the first bore and second bore and extending beyond said back of said vertical side of the L shaped bracket into said building through said first hole, said solid bar further being situated within and through said second hole in said composite support member and within and through said first end bore of said sheath, said third hole in said floor joist member and said second end bore of said sheath, thereby transferring load from the deck to said composite support member and floor joist member, said solid bar being further supported by said sheath disposed about said floor joist member, whereby a portion of the load of the deck would thereby be transferred to said building and the deck bracket would not be in direct contact with said building other than the solid bar, which would thus diminish or prevent the accumulation of moisture, thus preventing decay of structural load bearing components of the deck and building.

7. The apparatus of claim 6 wherein the first end and the second end of said solid bar are threaded, the first bore is threaded, the second bore is threaded, and the second end bore is threaded, whereby said second end of said solid bar is screwed into the second end bore and said L shaped bracket is screwed onto said first end of said solid bar thereby forming the deck bracket.

8. The apparatus of claim 6 wherein the plurality of bolt holes within said vertical face comprise an upper bolt hole and a lower bolt hole.

9. The apparatus of claim 6 wherein the solid bar, the L shaped bracket and the mounting support member are made of steel or such other strong metal or material of similar strength and characteristics and the sheath is made of steel, tin, aluminum or such other metal or man made material such as plastic, fiberglass, a composite material or the like, of similar strength and characteristics.

10. The apparatus of claim 6 wherein the solid bar is a cylindrical bar of one and one-quarter inches in diameter and has a length of two feet six inches to three feet, the L shaped bracket is made of one-half inch thick steel plate with a width of three inches, the front face of the vertical side is seven and one-half inches in length, the back of the vertical face is eight inches in length, the horizontal side of the L shaped bracket is three and one-half inches in length, the upper bolt hole and the lower bolt hole each have a diameter of seven-sixteenths of an inch, the upper bolt hole is centered at a point three-quarters of an inch down from the upper end of the vertical side and one and one-half inches from either edge of the vertical side of the L shaped bracket, the lower bolt hole is centered at a point five and five-eighths inches below the upper bolt hole and one and one-half inches from either edge of the vertical side of the L shaped bracket, the first bore has a diameter of one and one-quarter inches, centered at a point two and three-quarter inches below the upper end of the vertical side and one and one-half inches from either edge of the vertical side of the L shaped bracket, the mounting support member is two and one-half inches wide by two inches tall by three-quarters of an inch thick, said mounting support member being attached to the back of the vertical side at a point one and three-quarters inches down from the upper end of the vertical side and one-quarter inch from each side of the vertical side and four and one-quarter inches from the lower end of the vertical side, the second bore has a diameter of one and one-quarter inches and is centered at a point one inch from the top and bottom of the mounting support member and one and one-quarter inches from the sides of the mounting support member, the sheath is five and one-half inches wide by two and one-half inches deep by five and one-half inches tall, the first end bore and second end bore each have a diameter of one and one-quarter inches and are centered two and three-quarters inches from either side of the sheath at any point along that midline of the first wide side and second wide side, as the case may be, so long as the first end bore and second end bore are located at least one-half inch from the bottom of the sheath, and the sheath bolt holes are situated near each of the four corners of each of the first wide side and second wide side.

11. A method of attaching a deck to a building comprising the steps of:

attaching deck rim joist support members of said deck to a deck bracket, and fixing said deck bracket to said building;

said deck bracket comprising a solid bar, an L shaped bracket, a sheath and a mounting support member;

said solid bar having a first end and a second end;

said L shaped bracket having a vertical side and a horizontal side;

said vertical side comprising an upper end, a middle portion, a lower end, a front face, a back and a plurality of bolt holes;

said vertical side further comprising a first bore located between the upper end and the middle portion of the vertical side;

said mounting support member being fixedly attached to the back side of the vertical side;

said mounting support member comprising a second bore;

said first bore and said second bore being aligned in their relation to each other;

said first end of said solid bar being flush with said front face of said vertical side and being situated within said first bore and said second bore and attached to said vertical side and said mounting support member;

said sheath comprising a first wide side, a second wide side, two narrow sides, an inside, an outer side, a first end bore, a second end bore and sheath bolt holes;

said first end bore being situated within said first wide side;

said second end bore being situated within said second wide side;

said first end bore and said second end bore being aligned in their relation to each other;

wherein said sheath is positioned about and fixedly attached to a composite support member;

said composite support member being a structural supporting member of a building;

said second end of said solid bar being inserted through a first hole in said building and into and through said first end bore of said sheath, continuing through a second hole in said composite support member and further continuing into and through said second end bore, said first and second holes being aligned on a horizontal plane with said first bore, second bore, first end bore and second end bore;, whereby said first end of said solid bar and said L shaped bracket and said mounting support member of said deck bracket extend from an interior of said building such that said L shaped bracket is situated outside of and a distance from said building, said deck rim joist support members being seated on said horizontal side of said L shaped bracket and, fixedly attached to the front face of said vertical side of said L shaped bracket, said solid bar extending from the first bore and second bore and extending beyond said back of said vertical side of the L shaped bracket into said first hole of said building, said solid bar further being situated within and through said second hole in said composite support member, thereby transferring load from the deck to said member, said solid bar being further supported by said sheath disposed about said composite member, whereby a portion of the load of the deck would thereby be transferred to said building and the deck bracket would not be in direct contact with said building other than the solid bar, which would thus diminish or prevent the accumulation of moisture, thus preventing decay of structural load bearing components of the deck and building.

12. The method of claim 11 wherein the first end and the second end of said solid bar are threaded, the first bore is threaded, the second bore is threaded, and the second end bore is threaded, whereby said second end of said solid bar is screwed into the second end bore and said L shaped bracket is screwed onto said first end of said solid bar thereby forming the deck bracket.

13. The method of claim 11 wherein the plurality of bolt holes within said vertical face comprise an upper bolt hole and a lower bolt hole.

14. The method of claim 11 wherein the solid bar, the L shaped bracket and the mounting support member are made of steel or such other strong metal or material of similar strength and characteristics and the sheath is made of steel, tin, aluminum or such other metal or man made material such as plastic, fiberglass, a composite material or the like, of similar strength and characteristics.

15. The method of claim 11 wherein the solid bar is a cylindrical bar of one and one-quarter inches in diameter and has a length of seven inches, the L shaped bracket is made of one-half inch thick steel plate with a width of three inches, the front face of the vertical side is seven and one-half inches in length, the back of the vertical face is eight inches in length, the horizontal side of the L shaped bracket is three and one-half inches in length, the upper bolt hole and the lower bolt hole each have a diameter of seven-sixteenths of an inch, the upper bolt hole is centered at a point three-quarters of an inch down from the upper end of the vertical side and one and one-half inches from either edge of the vertical side of the L shaped bracket, the lower bolt hole is centered at a point five and five-eighths inches below the upper bolt hole and one and one-half inches from either edge of the vertical side of the L shaped bracket , the first bore has a diameter of one and one-quarter inches, centered at a point two and three-quarter inches below the upper end of the vertical side and one and one-half inches from either edge of the vertical side of the L shaped bracket, the mounting support member is two and one-half inches wide by two inches tall by three-quarters of an inch thick, said mounting support member being attached to the back of the vertical side at a point one and three-quarters inches down from the upper end of the vertical side and one-quarter inch from each side of the vertical side and four and one-quarter inches from the lower end of the vertical side, the second bore has a diameter of one and one-quarter inches and is centered at a point one inch from the top and bottom of the mounting support member and one and one-quarter inches from the sides of the mounting support member, the sheath is five and one-half inches wide by two and one-half inches deep by five and one-half inches tall, the first end bore and second end bore each have a diameter of one and one-quarter inches and are centered two and three-quarters inches from either side of the sheath at any point along that midline of the first wide side and second wide side, as the case may be, so long as the first end bore and second end bore are located at least one-half inch from the bottom of the sheath, and the sheath bolt holes are situated near each of the four corners of each of the first wide side and second wide side.

16. The method of claim 11 further comprising a floor joist member, whereby said sheath is positioned about and fixedly attached to said floor joist member;

said solid bar being inserted into and through said first hole in said building, said second end of said solid bar extending to and through said second hole of said composite member and to and through said first end bore of said sheath and continuing through a third hole within said floor joist member and further continuing into and through said second end bore, said first, second and third holes being aligned on a horizontal plane with said first bore, second bore, first end bore and second end bore;

whereby said deck bracket extends from an interior of said building such that the L shaped bracket is situated outside of and a distance from said building, said horizontal side of said L shaped bracket holding deck rim joist support members, said deck rim joist support members being fixedly attached to the front face of said vertical side of said L shaped bracket, said solid bar extending from the first bore and second bore and extending beyond said back of said vertical side of the L shaped bracket into said first hole of said building, said solid bar further being situated within and through said second hole in said composite support member, and within and through said first end bore of said sheath, said third hole in said floor joist member and said second end bore of said sheath thereby transferring load from the deck to said composite support member and said floor joist member, whereby a portion of the load of the deck would thereby be transferred to said building and the deck bracket would not be in direct contact with said building other than the solid bar, which would thus diminish or prevent the accumulation of moisture, thus preventing decay of structural load bearing components of the deck and building.

17. The method of claim 16 wherein the first end and the second end of said solid bar are threaded, the first bore is threaded, the second bore is threaded, and the second end bore is threaded, whereby said second end of said solid bar is screwed into the second end bore and said L shaped bracket is screwed onto said first end of said solid bar thereby forming the deck bracket.

18. The method of claim 16 wherein the plurality of bolt holes within said vertical face comprise an upper bolt hole and a lower bolt hole.

19. The method of claim 16 wherein the solid bar, the L shaped bracket and the mounting support member are made of steel or such other strong metal or material of similar strength and characteristics and the sheath is made of steel, tin, aluminum or such other metal or man made material such as plastic, fiberglass, a composite material or the like, of similar strength and characteristics.

20. The method of claim 16 wherein the solid bar is a cylindrical bar of one and one-quarter inches in diameter and has a length of two feet six inches to three feet, the L shaped bracket is made of one-half inch thick steel plate with a width of three inches, the front face of the vertical side is seven and one-half inches in length, the back of the vertical face is eight inches in length, the horizontal side of the L shaped bracket is three and one-half inches in length, the upper bolt hole and the lower bolt hole each have a diameter of seven-sixteenths of an inch, the upper bolt hole is centered at a point three-quarters of an inch down from the upper end of the vertical side and one and one-half inches from either edge of the vertical side of the L shaped bracket, the lower bolt hole is centered at a point five and five-eighths inches below the upper bolt hole and one and one-half inches from either edge of the vertical side of the L shaped bracket, the first bore has a diameter of one and one-quarter inches, centered at a point two and three-quarter inches below the upper end of the vertical side and one and one-half inches from either edge of the vertical side of the L shaped bracket, the mounting support member is two and one-half inches wide by two inches tall by three-quarters of an inch thick, said mounting support member being attached to the back of the vertical side at a point one and three-quarters inches down from the upper end of the vertical side and one-quarter inch from each side of the vertical side and four and one-quarter inches from the lower end of the vertical side, the second bore has a diameter of one and one-quarter inches and is centered at a point one inch from the top and bottom of the mounting support member and one and one-quarter inches from the sides of the mounting support member, the sheath is five and one-half inches wide by two and one-half inches deep by five and one-half inches tall, the first end bore and second end bore each have a diameter of one and one-quarter inches and are centered two and three-quarters inches from either side of the sheath at any point along that midline of the first wide side and second wide side, as the case may be, so long as the first end bore and second end bore are located at least one-half inch from the bottom of the sheath, and the sheath bolt holes are situated near each of the four corners of each of the first wide side and second wide side.

* * * * *